United States Patent [19]

Röck et al.

[11] Patent Number: 4,749,243

[45] Date of Patent: Jun. 7, 1988

[54] DRAWER WITH IMPROVED PULL-OUT RAIL, DRAWER FRAME AND RAIL SLIDE

[75] Inventors: Erich Röck; Josef Brunner, both of Höchst, Austria

[73] Assignee: Julius Blum Gesellschaft m.b.H., Höchst, Austria

[21] Appl. No.: 911,986

[22] Filed: Sep. 26, 1986

[30] Foreign Application Priority Data

Oct. 7, 1985 [AT] Austria ..... 2886/85

[51] Int. Cl.[4] ..... A47B 88/04

[52] U.S. Cl. ..... 312/341 AR; 312/330 R; 312/348

[58] Field of Search ..... 312/330, 348, 333, 341 R, 312/341 AR

[56] References Cited

U.S. PATENT DOCUMENTS

| | | | |
|---|---|---|---|
| 3,826,554 | 7/1974 | Cornell | 312/341 AR X |
| 4,392,696 | 7/1983 | Litchfield et al. | 312/330 R |
| 4,579,402 | 4/1986 | Wenzlick et al. | 312/330 R |

*Primary Examiner*—Joseph Falk

*Attorney, Agent, or Firm*—Wenderoth, Lind & Ponack

[57] ABSTRACT

A drawer has lateral drawer frames of injection molded plastics to which are fastened pull-out rails rolling on runner rollers at the sides of the body of an article of furniture. Slides are arranged at the rear sides of the drawer frames and at the pull-out rails. The slides engage the supporting rails at the side of the body and are movable therealong. The slides are inserted into the drawer frames from the rear thereof and have projections which engage in recesses of the respective drawer frames.

7 Claims, 4 Drawing Sheets

FIG. 1
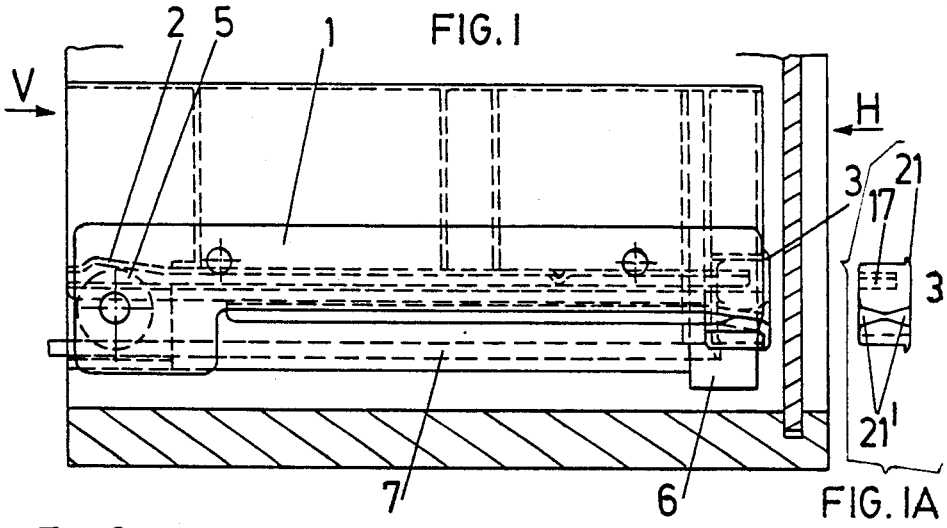
FIG. 1A
Fig. 3
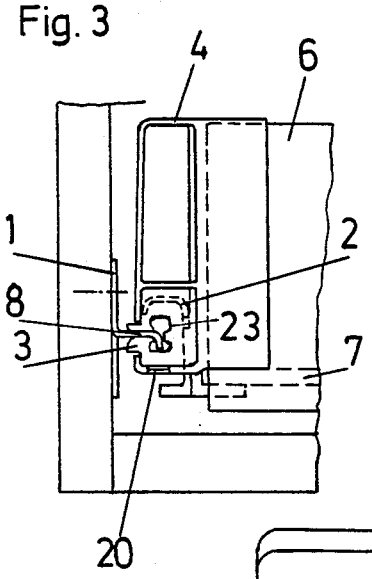
Fig. 4
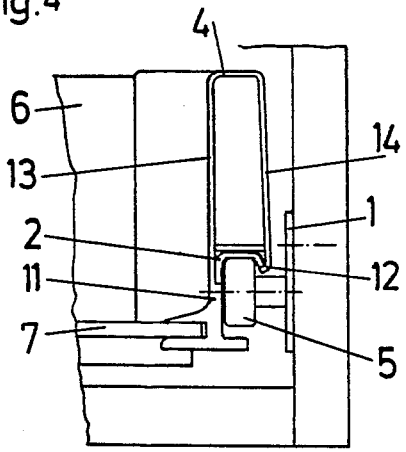
Fig. 5
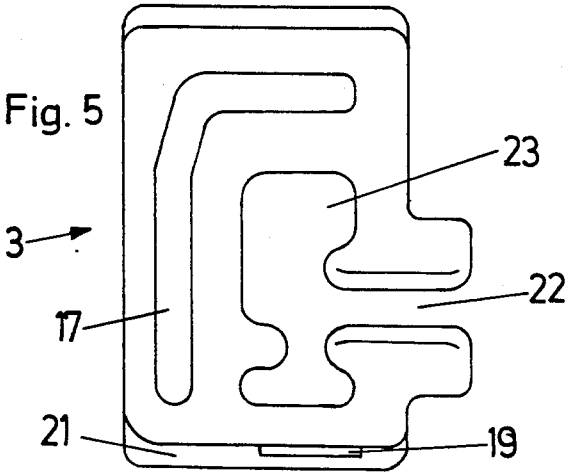

V Fig. 9 H
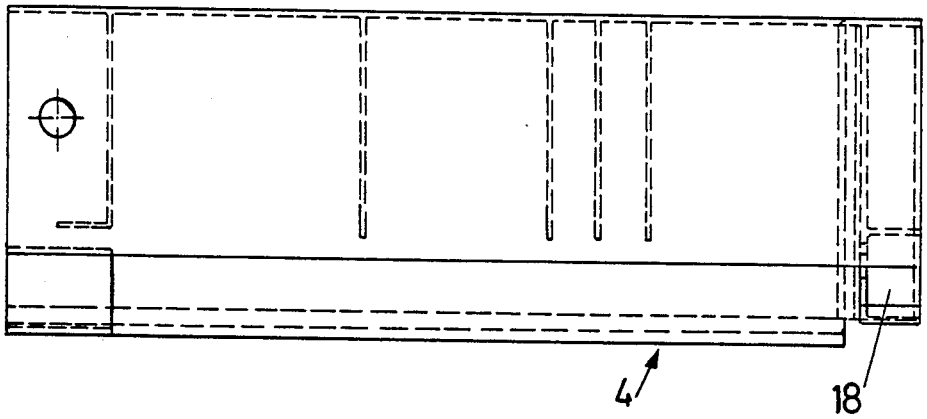
Fig. 10
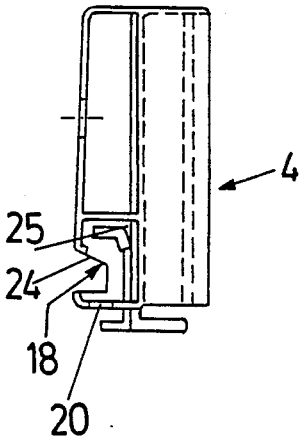
Fig. 11
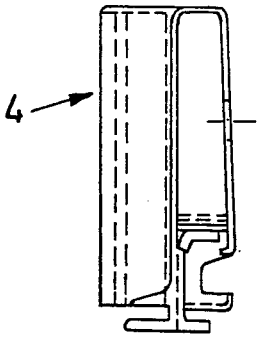
Fig. 12
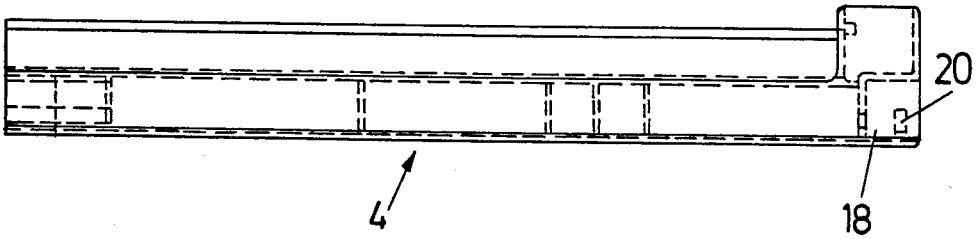

DRAWER WITH IMPROVED PULL-OUT RAIL, DRAWER FRAME AND RAIL SLIDE

FIELD AND BACKGROUND OF THE INVENTION

The present invention relates to a drawer having pull-out rails fastened to lateral drawer frames and rolling on runner rollers at the sides of a body, such as an article of furniture, slides arranged at the rear of the drawer frames or of pull-out rails engaging the supporting rails at the sides of the body and being movable therealong, and the drawer frames being double-walled.

Drawers with drawer frames of plastics material and pull-out rails of metal are widely known in modern furniture construction. Furthermore, drawers are known which have slides at their rear sides that are displaceable along supporting rails at the sides of the body and which roll at the front of the drawer on runner rollers at the sides of the body. The drawer is pivotally supported by means of the slides having slots into which extend horizontal flanges of respective of the supporting rails.

SUMMARY OF THE INVENTION

It is the object of the invention to provide an improved drawer of the above type wherein mounting of the three parts coacting during movement of the drawer is facilitated and improved.

According to the invention this object is achieved in that at each side of the drawer, a respective slide is inserted into the drawer frame and positioned between inner and outer walls of the drawer frame, and that the pull-out rail has a rear end inserted into the slide.

It is advantageously provided that the slide is inserted into the drawer frame from the rear and has a projection or nose which engages behind a projection and into a recess of the drawer frame. The nose prevents the slide from separating unintentionally from the drawer frame and, hence, from no longer supporting the pull-out rail.

An embodiment of the invention provides that the pull-out rail has a U-shaped profile and a rear portion with an L-shaped profile extending into the slide. The pull-out rail advantageously projects into a hole formed in the slide.

Separate drawer frames may be provided, e.g. a drawer frame at each side of the drawer and a drawer frame forming the rear wall of the drawer, the drawer frames being connected to one another in a conventional manner, for example by means of snap-in mechanisms, or the complete frame of the drawer at the sides and at the rear being made in one piece. To improve the support of the pull-out rail in the drawer frame, advantageously the drawer frame has a vertical flange with a perforation through which projects the pull-out rail.

An embodiment of the invention provides that the drawer frames are double-walled and have at both sides, at least at their fronts, inwardly directed projections, with the pull-out rails resting on such projections.

In each drawer frame, which advantageously is injection-molded, is formed a chamber that is completely filled a respective slide. Thus, the slide is fastened in the drawer frame in a compact manner. Since the slide is made of plastics material, it is resilient to a certain extend and therefore able to embrace the pull-out rail in the chamber with slight pressure.

BRIEF DESCRIPTION OF THE DRAWINGS

Below an embodiment of the invention will be described in more detail with reference to the accompanying drawings in which:

FIG. 1 is a side view of a drawer according to the invention, the drawer being shown inserted into the body of an article of furniture, shown in section;

FIG. 1*a* is a side view of a slide used in the drawer of FIG. 1;

FIG. 3 is an end view in the direction of arrow H of FIG. 1;

FIG. 4 is an end view in the direction of arrow V in FIG. 1;

FIG. 5 is a front view of a slide;

FIG. 9 is a side view of a drawer frame;

FIG. 10 is an end view from the direction of arrow H of FIG. 9;

FIG. 11 is an end view from the direction of arrow V of FIG. 9; and

FIG. 12 is a top view of the drawer frame.

DESCRIPTION OF THE PREFERRED EMBODIMENT

Figure 2:
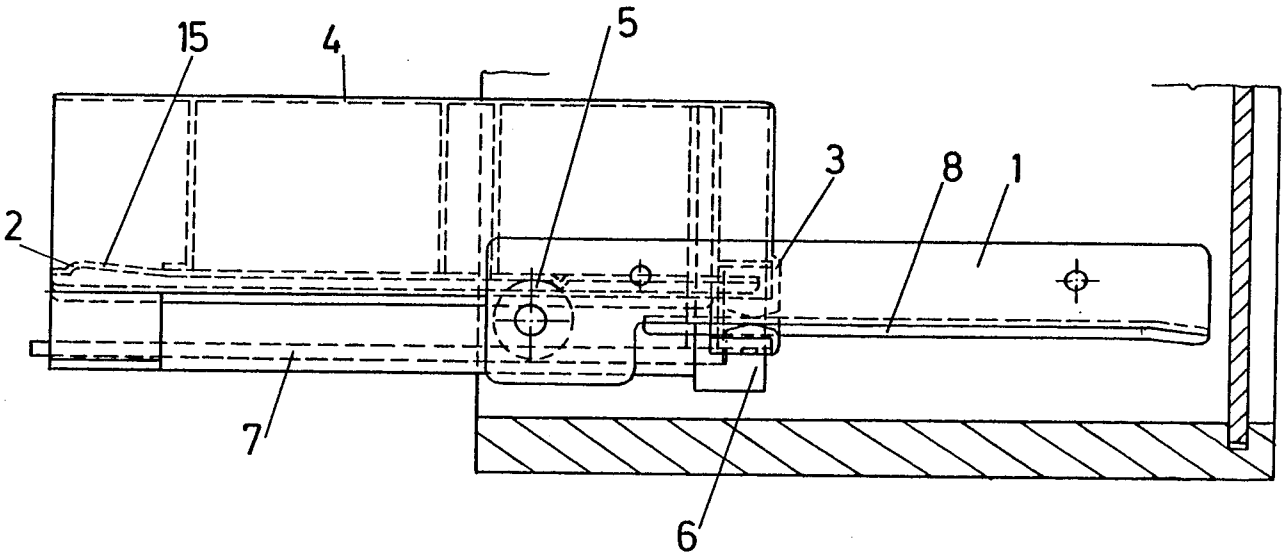
FIG. 2 is a side view of the drawer according to the invention, the drawer being shown in the extracted position.
Figure 6:
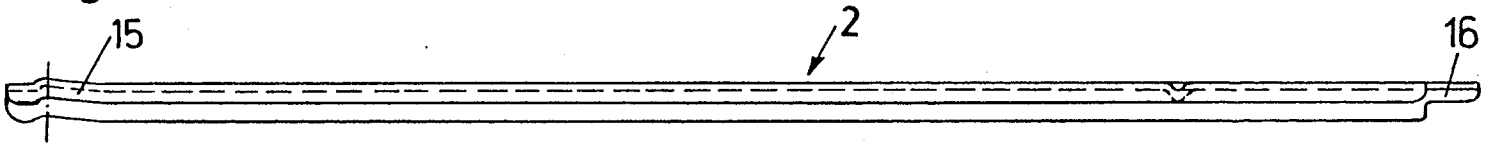
FIG. 6 is a side view of a pull-out rail.
Figure 7:
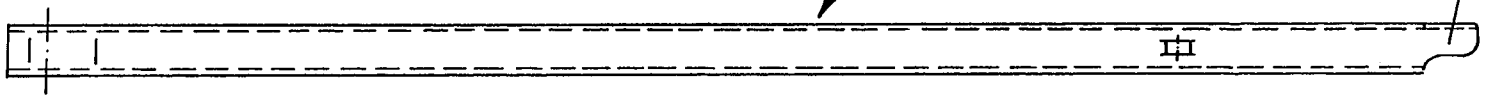
FIG. 7 is a top view of the pull-out rail.
Figure 8:
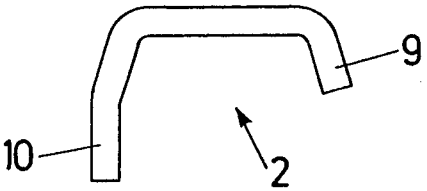
FIG. 8 is a front view of the pull-out rail.

In the following description reference will be made to one side of the drawer only, the other side being made in an analogous manner. The essential parts of each side of the drawer according to the invention are a pull-out rail 2, a slide 3 and a drawer frame 4 which is preferably of injection-molded plastics material.

In FIGS. 1 to 4, the rear wall of the drawer has reference number 6, and the bottom of the drawer has reference number 7. A supporting rail 1 is fastened to the side wall of the article of furniture. A runner roller 5 is mounted at the front of the side wall of the article of furniture. Runner roller 5 could be replaced by a slide if the drawer does not have to carry heavy loads.

As can be seen from FIGS. 1 to 4, pull-out rail 2 is fastened to drawer frame 4 and rides on the runner roller 5. Also, slide 3 is mounted on drawer frame 4 and embraces one horizontal flange 8 of the supporting rail 1.

The pull-out rail 2 has two lateral flanges 9 and 10, both of which have lengths less than the radius of the runner roller 5. The pull-out rail 2 is inserted into the drawer frame 4 with the two lateral flanges 9, 10 abutting with projections 11, 12 of the walls 13, 14 of the drawer frame 4. In this arrangement, the projection 11 is a shoulder and the projection 12 is a bent flap. The projections 11, 12 may either extend over the length of the drawer frame 4 or be arranged only in the front region thereof.

The rear end of pull-out rail 2 has a portion 16 having an L-shaped profile and extending into the slide 3. Slide 3 is provided with a correspondingly shaped hole 17 (see FIG. 5).

As can be seen from FIGS. 1 and 2, the slide 3 is inserted into the drawer frame 4 from the rear. Receiving chamber 18 (see FIG. 12) is formed at the rear of drawer frame 4 for this purpose. Receiving chamber 18 is substantially filled with the slide 3 so that sufficient friction is provided for the slide 3 to slidingly hold the pull-out rail 2. The slide 3 has a projection or nose 19 which extends into a recess 20 in the bottom drawer frame 4. When the slide 3 is pushed into the drawer frame 4, the nose 19 engages in the recess 20, and the slide 3 is fixedly held in place in the drawer frame 4. At the rear of slide 3 is a rim 21 which abuts at the rear wall of the frame 4. The slide 3 further has a slot 22 through which projects the horizontal flange 8 of the supporting rail 1. The interior or central portion of the slide 3 is provided with a chamber-like recess 23 to improve the resilience of the slide 3.

As can be seen from FIG. 1*a*, the longitudinal contour of slot 22 of the slide 3 is substantially X-shaped, e.g. by merging apices of two funnels or triangles 21'. Tilting of the pull-out rail 2 in the slide 3 is thus prevented. Furthermore, the sliding properties of the slide 3 are improved.

In the region of chamber 18, i.e. at the front thereof, the drawer frame 4 is provided with a vertical flange 24 which has a perforation or opening 25. Perforation 25 corresponds to the profile of portion 16 of the pull-out rail 2, and the pull-out rail 2 is insertable through perforation 25 into the chamber 18 and, hence, into the slide 3.

The front plate of the drawer is not shown in the drawings since it does not form the subject matter of the present invention.

What is claimed is:

1. A drawer for insertion into and withdrawal from an article of furniture, said drawer having a construction on each of opposite sides thereof comprising:

a double-wall drawer frame having inner and outer walls and forming a side wall of said drawer;

a pull-out rail mounted between said inner and outer walls of said drawer frame, said pull-out rail having surface means for slidingly engaging a supporting structure to be mounted on a respective side of the article of furniture for supporting said drawer;

a slide inserted in a rear portion of said drawer frame and positioned between said inner and outer walls thereof, said slide having means for slidingly engaging and being supported by the supporting structure; and said pull-out rail having a rear end portion extending into and being supported by said slide.

2. A drawer as claimed in claim 1, wherein said slide extends into said drawer frame from the rear end thereof, and said slide includes a projection extending into a recess formed in said drawer frame, thereby retaining said slide in position within said drawer frame.

3. A drawer as claimed in claim 2, wherein said drawer frame has formed at said rear end thereof a chamber, and said slide substantially fills said chamber.

4. A drawer as claimed in claim 1, wherein said pull-out rail has a U-shaped cross section, except for said rear end portion which has an L-shaped cross section and which extends into a complementarily shaped opening in said slide.

5. A drawer as claimed in claim 1, wherein said rear end portion of said pull-out rail extends into a complementarily shaped opening in said slide.

6. A drawer as claimed in claim 1, wherein said drawer frame includes a vertical wall extending between said inner and outer walls, said vertical wall having therethrough an opening, and said pull-out rail extends through said opening.

7. A drawer as claimed in claim 1, further comprising projections extending inwardly from at least forward portions of said inner and outer walls of said drawer frame, said pull-out rail resting on and being supported by said projections.

* * * * *